United States Patent [19]

Corsette

[11] Patent Number: 4,545,130

[45] Date of Patent: Oct. 8, 1985

[54] DESIGNER'S TRIANGLE

[76] Inventor: Douglas F. Corsette, 6559 Firebrand St., Los Angeles, Calif. 90045

[21] Appl. No.: 525,605

[22] Filed: Aug. 22, 1983

[51] Int. Cl.[4] ..... B43L 13/00

[52] U.S. Cl. ..... 33/474; 33/482

[58] Field of Search ..... 33/474, 476, 494, 429, 33/403, 482, 427, 429, 477

[56] References Cited

U.S. PATENT DOCUMENTS

| | | | |
|---|---|---|---|
| 777,407 | 12/1904 | Early | 33/474 |
| 2,043,729 | 6/1936 | Bilder | 33/476 |
| 2,080,620 | 5/1937 | Martin . | |

FOREIGN PATENT DOCUMENTS

| | | | |
|---|---|---|---|
| 127143 | 3/1946 | Australia . | |
| 91801 | 5/1897 | Fed. Rep. of Germany | 33/429 |
| 331113 | 12/1920 | Fed. Rep. of Germany | 33/429 |
| 585040 | 9/1933 | Fed. Rep. of Germany . | |
| 592640 | 2/1934 | Fed. Rep. of Germany | 33/429 |
| 865714 | 2/1953 | Fed. Rep. of Germany . | |
| 908490 | 9/1945 | France . | |
| 1022765 | 12/1952 | France . | |
| 1086675 | 8/1954 | France . | |
| 301443 | 10/1932 | Italy . | |
| 154211 | 7/1932 | Switzerland . | |
| 276736 | 10/1951 | Switzerland . | |
| 616080 | 1/1949 | United Kingdom | 33/476 |
| 667634 | 5/1952 | United Kingdom . | |

*Primary Examiner*—Harry N. Haroian

*Attorney, Agent, or Firm*—Henry M. Bissell

[57] ABSTRACT

A designer's triangle which permits completion of a drawing with the use of a single instrument includes a planar sheet having three external edges forming a triangle with angles of 45°, 60° and 75°, respectively. The planar sheet defines three-sided first and second internal triangular cutout openings having respective edges lying along perpendiculars to edges of the external triangle and a trisector of the 45° angle. In some preferred embodiments these perpendiculars intersect at a common point and may constitute altitudes of the external triangle.

29 Claims, 7 Drawing Figures

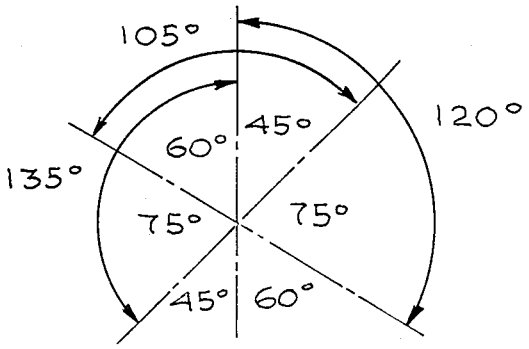
Fig. 3A
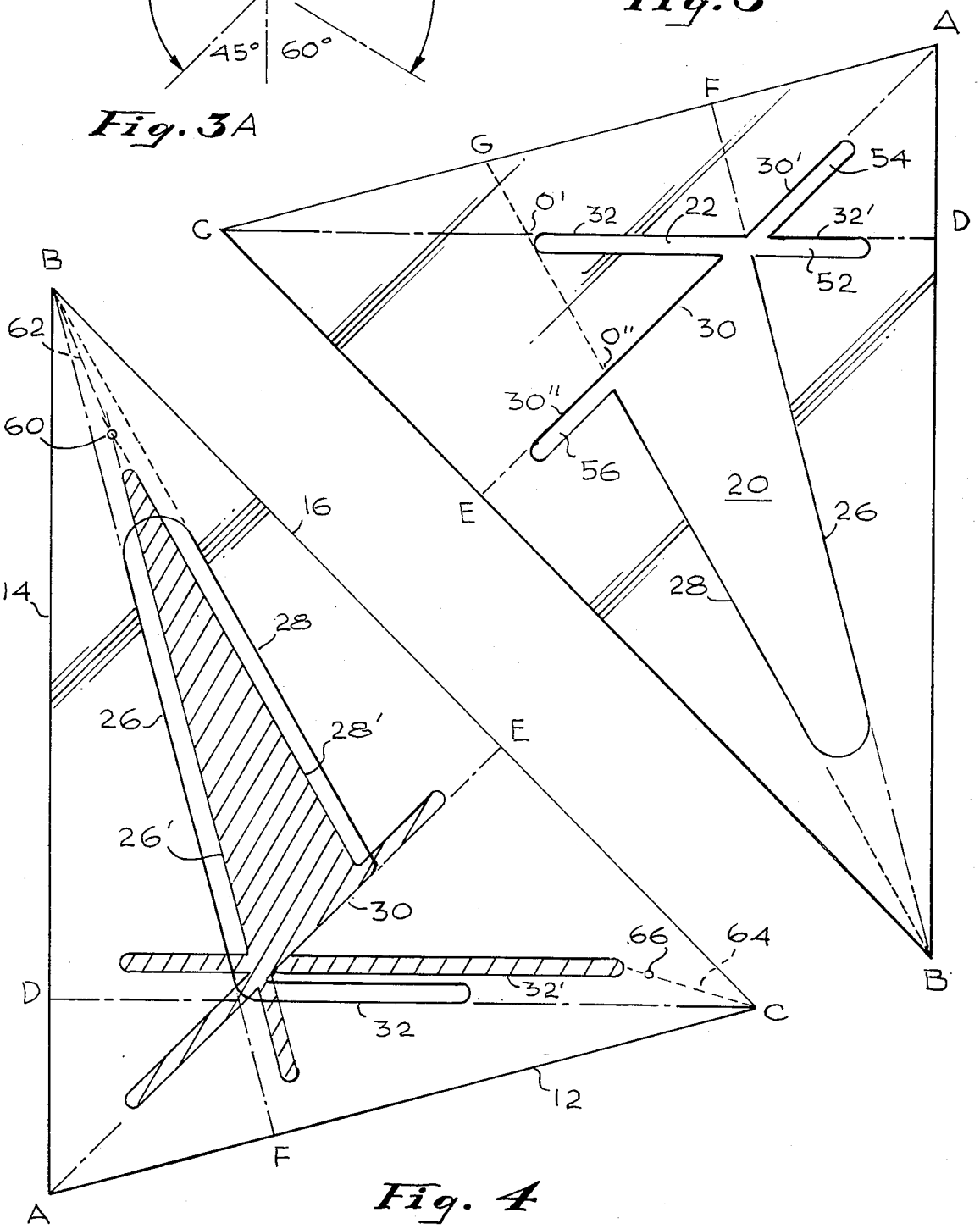
Fig. 3
Fig. 4

DESIGNER'S TRIANGLE

BACKGROUND OF THE INVENTION

1. Field of the Invention

This invention relates principally to designer's triangles, and more particularly to triangles wherein a single implement has the capabilities of most of the known triangles, and thus eliminates the need for the use of at least two different triangles to perform designated tasks.

2. Description of the Prior Art

There are numerous triangles and protractors known in the art, and many are commercially available. One common form includes means for setting an adjustable angle which can be used to produce many different angles, as well as read angles off of drawings. Such equipment, however, is obviously subject to shifting and moving, if not exactly positioned or tightened, and thus requires a great deal of care in order to prevent errors in making drawings. In addition, in classroom drafting situations, protractors that have a plurality of holes, variable curvature arcs, a scale, and a few defined angles are well known. However, this type of unit does not provide for the production of numerous angles, and requires other equipment to produce drawings with angles other than the normal 30° and 45° angles provided on these units.

U.S. Pat. No. 2,080,620 discloses a drafting implement providing 15°, 30°, 45°, 60°, and 90° angles but, due to its four-sided "boomerang" shape, it only allows for a 15° angle from the horizontal. Additionally, due to its shape, a straight edge is not provided along two of the sides for use directly adjacent a tee square. Thus this instrument lacks the versatility of a triangular instrument, and other devices would be needed for efficient designing and drafting.

Swiss Pat. No. 276,736 of Clerc discloses a number of shapes formed of sheet plastic, including triangular shapes. Some of these shapes are provided with internal cutouts to provide additional straight edges at selected angles with the outside edges of the shape. One particular shape is a 45°, 60°, 75° triangle with an internal triangular cutout having its edges oriented at 15° to corresponding adjacent external edges.

Australian Pat. No. 127,143 of Calvert discloses a number of right triangular shapes formed of sheet plastic having an internal triangular cutout with one internal edge parallel to a corresponding adjacent external edge and the other two internal edges being at 15° to their respective corresponding adjacent external edges.

French Pat. No. 1,022,765 of Queret discloses a quadrilateral shape of sheet plastic or the like in the form of two right triangles placed edge to edge along their hypotenuses. The quadrilateral shape has a plurality of internal cutouts resembling various geometrical shapes.

Other examples of drafting implements, straight edges and linear measurement instruments may be found in British Pat. No. 667,634 of Bradler, French Pat. Nos. 908,490 of Picard and 1,086,675 of Eggimann, Swiss Pat. No. 154,211 of Wolf, Italian Pat. No. 301,443 of Del Moro and German Pat. Nos. 585,040 of Ruckert et al and 865,714 of Beckenlechner.

SUMMARY OF THE INVENTION

Arrangements in accordance with the present invention comprise a single designer's triangle having three external edges, with internal cutouts for both horizontal and vertical alignment of nearly any angle in 15° increments. Thus use of this implement permits a designer to generate all of the usual right triangle angles formerly requiring use of two separate triangles (45°-45° and 30°-60° triangles, for example).

More particularly, the three external edges of the triangle of the present invention, at their intersections, form or define angles of 75°, 60° and 45°. This triangle can be considered to be equivalent to a combination of the two common engineering or designer's triangles which are right triangles of 45°-45° and 30°-60°. In addition, a generally central portion of the planar sheet material, preferably of clear transparent plastic or the like, utilized to provide the triangle of the present invention is cut out to form an internal triangle and a slot contiguous to one corner of the internal triangle. The slot is of a width adequate to permit the ready insertion of a drafting instrument, such as a pencil or a pen, etc., into the slot to follow an edge of the slot in drawing a line. Two edges of the triangle and one edge of the slot are the three altitudes of the external triangle—i.e., the perpendiculars to the three sides which intersect the opposite apex of the external triangle.

The third side of the internal triangular portion of the cutout is established along a trisector of the external triangle 45° angle, the perpendicular through the 45° angle being the other trisector. Thus, the two sides of the internal triangle cutout form 15° angles with each other and with their respective adjacent edges of the external triangle. The angles of the internal triangular cutout are 15°, 105° and 60°. In addition, there is a second triangular outline formed by the internal triangle and contiguous slot. This outline is similar but a mirror image to the internal triangle cutout, having also angles of 15°, 105° and 60°. One side is coincident with the one side of the internal triangle; the second side is an extension of the 45° trisector (also forming a side of the first internal triangle); and the third side is the edge of the slot.

Construction of the internal cutout within the external triangle thus described advantageously results in the provision of readily available angles from 15° to 135° in 15° increments and with multiple accessibility from the various edges available for use as a base reference. With ordinary engineering triangles, it is necessary to use both the 45°-45° and 30°-60° triangles to draft a 15° angle to either a horizontal or a vertical line in either right or left hand direction or in an up or down deflection. The triangle of the present invention contains both of these ordinary engineering triangles so that all such angles are capable of development without the need for a second instrument. Since the altitudes of a triangle having three acute angles intersect at a common point within the triangle, the development of the cutout in the triangle of the present invention with edges along the three altitudes of the external triangle provides access to lines which intersect at the point of intersection of the altitudes, thus providing a perpendicular and additional internal angles which are multiples of 15°, thereby enhancing the number of combinations of edges which may be used by a draftsman for drafting lines at various commonly selected angles.

One series of alternative arrangements to the basic embodiment just described involves the extension of the shorter edges of the triangular cutout forms in order to provide the draftsman with the facility for drawing longer lines than may be possible with a basic implement. It should be borne in mind, however, that it is important to maintain structural integrity of the designer's triangle, so that these extended edges should not be allowed to approach so closely to the exterior edges of the external triangle as to unduly weaken the structure. In other variations of arrangements in accordance with the present invention, one or more selected edges of the internal cutout can be moved parallel to its corresponding edge of the basic configuration described hereinabove. Translation of an edge in this manner (parallel to its corresponding edge in the basic configuration) may be desirable to enhance the structural integrity of the overall implement and/or to extend the length of one or more of the internal edges to provide a longer working length. The same range of angles is provided—15° to 135° in 15° increments—although the perpendiculars of the sides of the external triangle along which the internal edges are formed may no longer pass through the apices of the external angles.

In one variant of the basic configuration of the invention, the designer's triangle may be constructed with the various edges along the perpendiculars intersecting at a common point within the external triangle, although these perpendiculars are not altitudes of the external triangle. Instead, for ease of visualization, these perpendiculars may be considered to be the altitudes of a "phantom" triangle which is circumscribed by the edges of the external triangle. In effect, for purposes of construction, the external edges may be visualized as having been translated outwardly, parallel to the corresponding edges of the phantom triangle, in order to develop the desired structural integrity of the drafting implement of the invention.

BRIEF DESCRIPTION OF THE DRAWING

A better understanding of the present invention may be had from a consideration of the following detailed description, taken in conjunction with the accompanying drawing in which:

FIG. 3 is a further variant of the arrangement of FIG. 1, and accompanying FIG. 3A shows the interior angles formed at the point of intersection of the respective perpendiculars;

FIG. 4 is another embodiment illustrating the shape of the internal cutout which is developed by translating the respective internal edges inwardly, away from the external edges of the implement;

DESCRIPTION OF THE PREFERRED EMBODIMENTS

Figure 1:
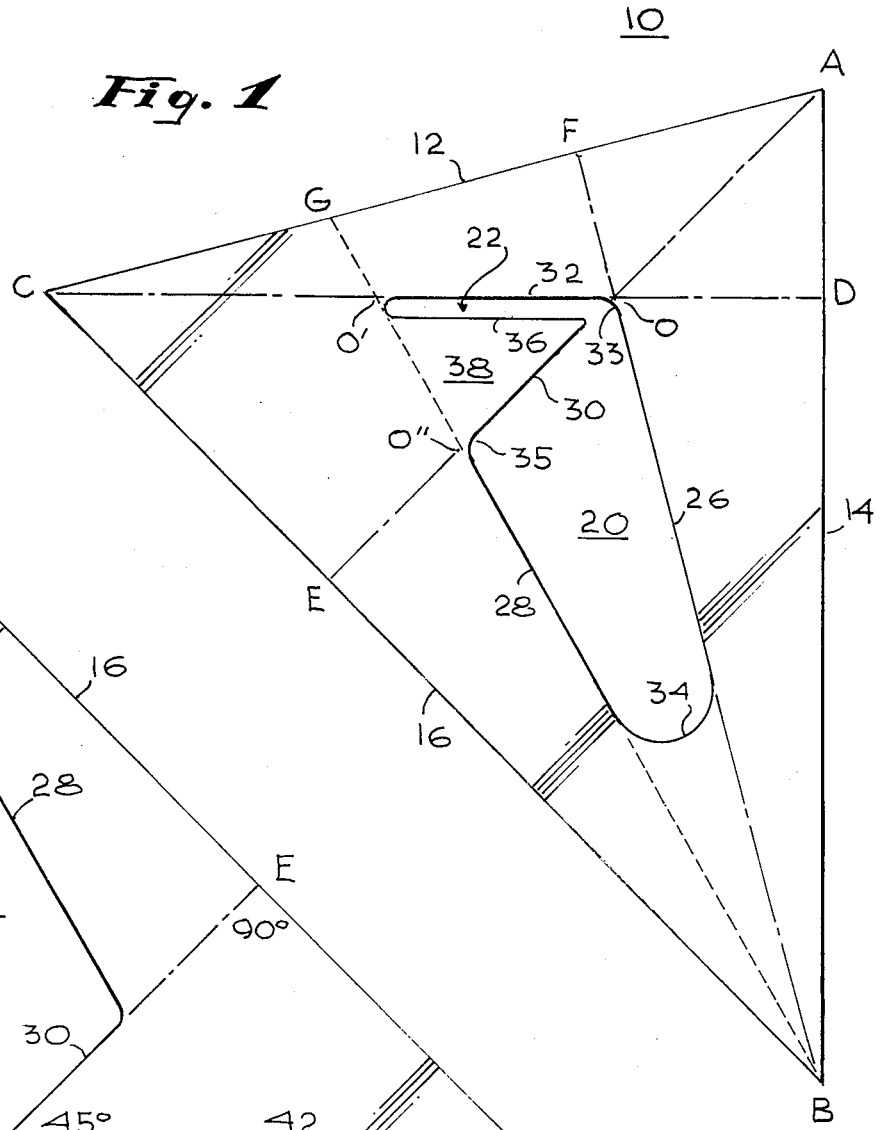
FIG. 1 is a representation of a designer's triangle in accordance with the present invention, illustrating what has been referred to above as the basic configuration of the invention.

In FIG. 1, a triangular implement 10 (herein referred to conveniently as "triangle") is shown having external edges 12, 14 and 16. Edges 12 and 14 intersect at point A and form an angle of 75°. Edges 14 and 16 intersect at point B and form an angle of 45°. Edges 16 and 12 intersect at point C and form an angle of 60°.

The altitudes of the external edge defined triangle are defined by lines EA, FB and DC. Altitude EA intersects the vertex of the 75° angle at point A, and forms a 30° angle with line CA. Altitude FB intersects the vertex of the 45° angle and forms one trisector of the 45° angle of the external triangle. Altitude DC intersects the vertex of the 60° angle, and forms a 15° angle with line CA.

The aforementioned altitudes intersect at a common point, designated O. The other trisector of the 45° angle of the external triangle is defined by line BG. Trisector BG intersects altitudes DC and EA at points O′ and O″ respectively. Triangle ABG is an isosceles triangle with side BG equal to side BA.

Cutout portions 20 and 22 are provided internally of the triangle defined by points A, B, and C to provide edges 26, 28, 30, and 32. Edges 26, 28 and 30 define lines which form a first internal triangle BOO″. This first internal triangle, as can be seen from FIG. 1, has a first side which lies on line FB, a second side which lies on line BG and a third side which lies on line EA. Thus the edges 26 and 28 lie on the trisectors of the 45° angle ABC of the external triangle and so are at 15° to each other. In this first internal triangle 20 of the cutout shown, the corners of the triangles are relieved at 33, 34 and 35 by the provision of curves of common radii to avoid stress concentration at points of intersection. The line defined by edge 30 intersects the line defined by edge 26 to form an angle of 60°. The line defined by edge 28 intersects the line defined by edge 30 to form an angle of 105°. The first internal triangle 20 thus has angles of 15°, 60°, and 105°.

As can be seen, the planar sheet which forms the triangle of the present invention includes a triangular projection 38 which extends between cutouts 20 and 22. One edge of the triangular projection 38 defines edge 30, and a second edge of the triangular projection 38 forms and defines edge 36. The base of the projection 38 lies on the trisector BG of the 45° angle. Edges 32 and 36 of the slot 22 are conveniently made to be parallel.

The designer's triangle of the present invention can be considered to have a second internal triangle comprised of lines defined by edges 26, 28 and 32. Thus the first and second internal triangular cutouts have two sides in common, i.e., first and second sides defined by lines which lie on edges 26 and 28. The third side of the second internal triangle is formed by edge 32.

The line defined by edge 32 intersects the line defined by edge 26 at an angle of 105° and extends between points O and O′ so as to lie on altitude DC. The line defined by edge 28 intersects the line defined by edge 32 to form an angle of 60° and lies on trisector BG of the 45° angle. As previously mentioned, the lines defined by edges 26 and 28 lie on trisectors of the 45° angle and thus define a 15° angle which is common to both the first and second internal triangle cutouts. Thus, the second internal triangle BOO′ has its angles equal to the angles of the first internal triangle BOO″, namely 15°, 60° and 105°, and the two internal triangles are mirror images of other.

The triangle of the present invention may be considered to be formed of the two common engineering right triangles—30°-60° and 45°-45°—placed edge-to-edge along a common side, the line AE (with the internal cutout as shown, of course). As is clear in FIG. 1, this common side coincides with one of the edges of the internal cutout. There are other paired combinations of the common engineering triangles included within the triangle of the present invention, each pair sharing a common edge and having one or more sides aligned with respective edges of the internal cutout. For example, triangles CFB, a 30°-60° triangle, and CDB, a 45°-45° triangle, are included in the triangle ABC of FIG. 1 and share a common edge (their hypotenuse BC). Line CD, a side of triangle CDB, is along the internal edge 32 of cutout slot 22; line BF of triangle CFB is along the internal edge 26. Similarly, the triangle 10 of FIG. 1 includes triangles COE, a 45°-45° triangle, and BOE, a 30°-60° triangle, sharing the common edge OE. This common edge OE is coincident with the internal edge 30; in addition, the edge OC of included triangle COE is coincident with the internal edge 32 and the edge BO of included triangle BOE is coincident with the internal edge 26. Moreover, the common engineering triangles are also included in the upper portion of triangle 10 of FIG. 1 as triangles AFO, a 30°-60° triangle, and triangle ADO, a 45°-45° triangle, sharing the common edge AO. The common edge AO lies along an extension of the internal edge 30 or the actual slot extensions 45, 54 (see FIGS. 2 and 3). Also, the edges FO and DO of these included triangles lie along extensions of the internal edges 26 and 32, respectively. As shown in FIG. 3, the lengthened slot 52 with internal edge 32' extends along the line DO.

Figure 2:
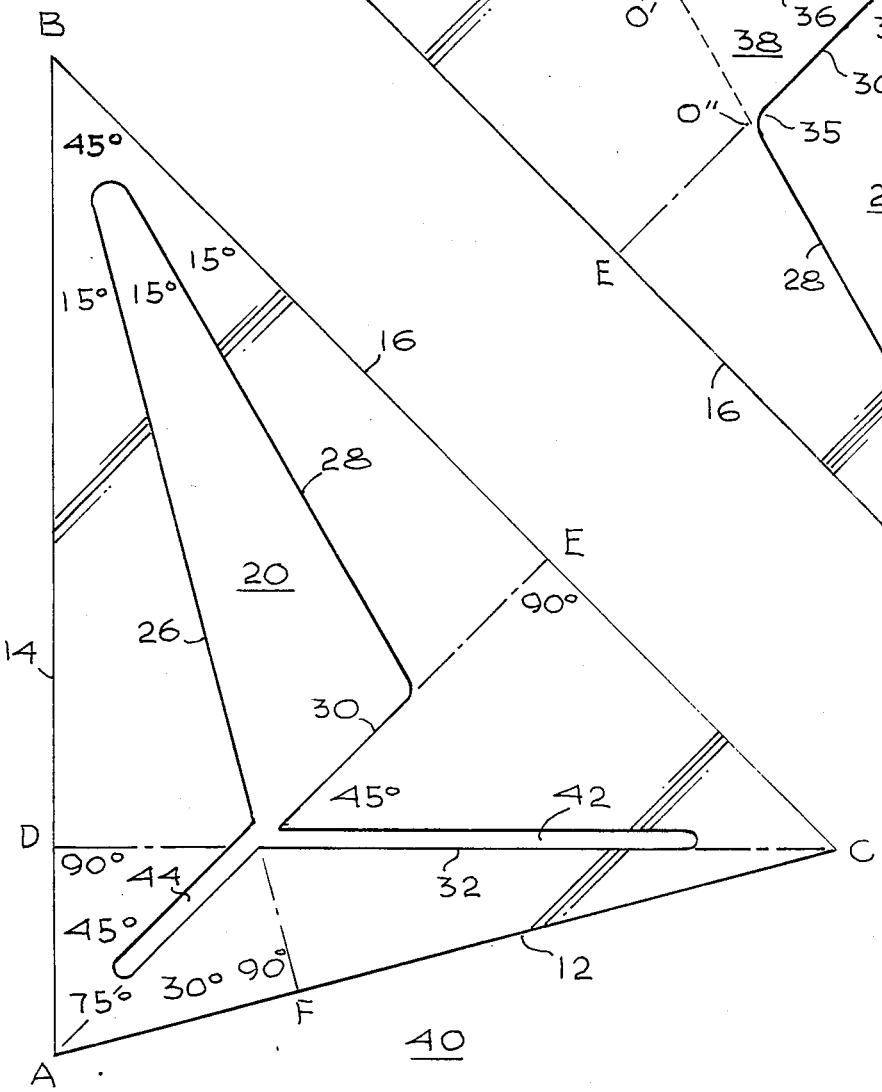
FIG. 2 shows a modification of the arrangement of FIG. 1 and indicates some of the various angles available to the user of the implement.

FIG. 2 shows an implement 40 which is similar to the implement 10 of FIG. 1 except that the edge 32 has been extended to form a longer slot 42 and the edge 30 has been extended to form an additional slot 44. Various angular values are shown at various points on FIG. 2 to illustrate some of the angles which are available to the user of the implement in a plurality of occurrences as intersections between pairs of the multitude of edges available for drawing lines. FIG. 2 corresponds to FIG. 6 of my prior U.S. Pat. No. 4,345,383.

FIG. 3 illustrates a slightly different variation of the basic configuration of FIG. 1. In this figure, the implement 50 provides the same internal cutouts 20 and 22 of FIG. 1 with the edge 32 extended in the opposite direction from that shown in FIG. 2 to provide an additional slot 52. In addition, the edge 30 is extended in both directions to provide additional slots 54, 56, having edges 30' and 30'' respectively.

For the triangles of the arrangements shown, the external edges intersect at angles of 45°, 60° and 75°. There are three internal edges aligned respectively at 90° to corresponding external edges. These variously provide angles of 15°, 30°, 45° and 90° to the various external edges. Angles of 15°, 60°, 75° and 105° are available between respective internal edges of the cutout, apart from the angles shown in FIG. 3A as existing at the point O, defining the various internal angles available from the various internal edges intersecting at this point.

The interior cutout of the implement of FIG. 1 is a dual triangular form defined by two triangular figures having equal interior angles of 15°, 60° and 105°. These two triangles have a common apex angle whose sides trisect the 45° apex angle of the exterior triangle. The base of each interior triangle lies on an altitude to a lateral edge of the exterior triangle.

In the implements shown in FIGS. 2 and 3, the edges of the interior triangles have been extended to form exterior angles with the sides of these triangles. In FIG. 3, the bases (short sides) of both interior triangles are extended so that they intersect each other as well, forming alternate angles of 45° with each other and additional angles with the mirrored triangle, as illustrated in FIG. 3A. Thus a multiplicity of often used angles in 15° increments is directly accessible from a convenient edge, ranging from 15° to 135°, using only this engineering instrument, thereby obviating the need for the customary two engineering triangles but also containing both conventional triangles within its confines in several arrangements, as noted above.

Looked at from another point of view, one may consider the multiplicity of angles available from the respective perpendiculars (the internal edges 26, 28 and 32) of FIG. 3 for example. From the edge 26, one may draft lines at respective angles of 15°, 30°, 60°, 75°, 90°, 105° and 120°. From the edge 32—32', one may draft lines at respective angles of 15°, 45°, 60°, 75°, 90°, 105° and 135°. From the edge 30 (30'—30'') one may draft lines at respective angles of 30°, 45°, 60°, 75°, 90°, 105°, 120° and 135°.

One may find it advantageous, in order to preserve the structural integrity of the designer's implement of the invention, to translate one or more of the internal edges to a position parallel to the corresponding altitude of the external triangle. When an internal edge is translated parallel with an apex perpendicular, it forms a similar triangle with one of the related 30°-60° or 45°-45° right triangles, but it may cause one or more interior triangles to have the apex of one of its angles intercept outside the external triangle. Alternatively, the point of intersection may be within the external triangle and with one side or both sides of the resulting angle not passing through the apex of an angle of the external triangle. However, the length of the internal edges can thus be extended to a longer working length if the slot terminates on the angle bisector of the external angle.

An example of such translation of internal edges is illustrated in FIG. 4. This shows the basic configuration of FIG. 1 on which is interposed an internal cutout, shown in cross-hatched form for purposes of clarity. In FIG. 4, edges 26' and 28' of the first internal triangle are shown translated parallel to the trisectors of the angle B. These internal edges 26', 28', if extended, intersect at point 60 which is on the line 62 representing the bisector of the angle B. Also, the edge 32' is translated parallel to the original edge 32 and terminates along a bisector 64 of the angle C. If desired, small holes 60, 66 may be provided along the respective bisectors 62 and 64 for utilization in drafting lines to the bisectors of these angles B and C. Translation of the edges in the manner shown in FIG. 4 results in increased working length of the slots and other edges provided, while at the same time preserving the structural integrity of the implement. Thus, drafting convenience is achieved by lateral translation of a perpendicular slot or edge to a position parallel to the original location passing through the apex of the external angle. Although these perpendiculars may not now intersect at a common point, the same angles are represented on the whole, with the exception of the alternate interior angles illustrated in FIG. 3A.

Figures 5, 6:
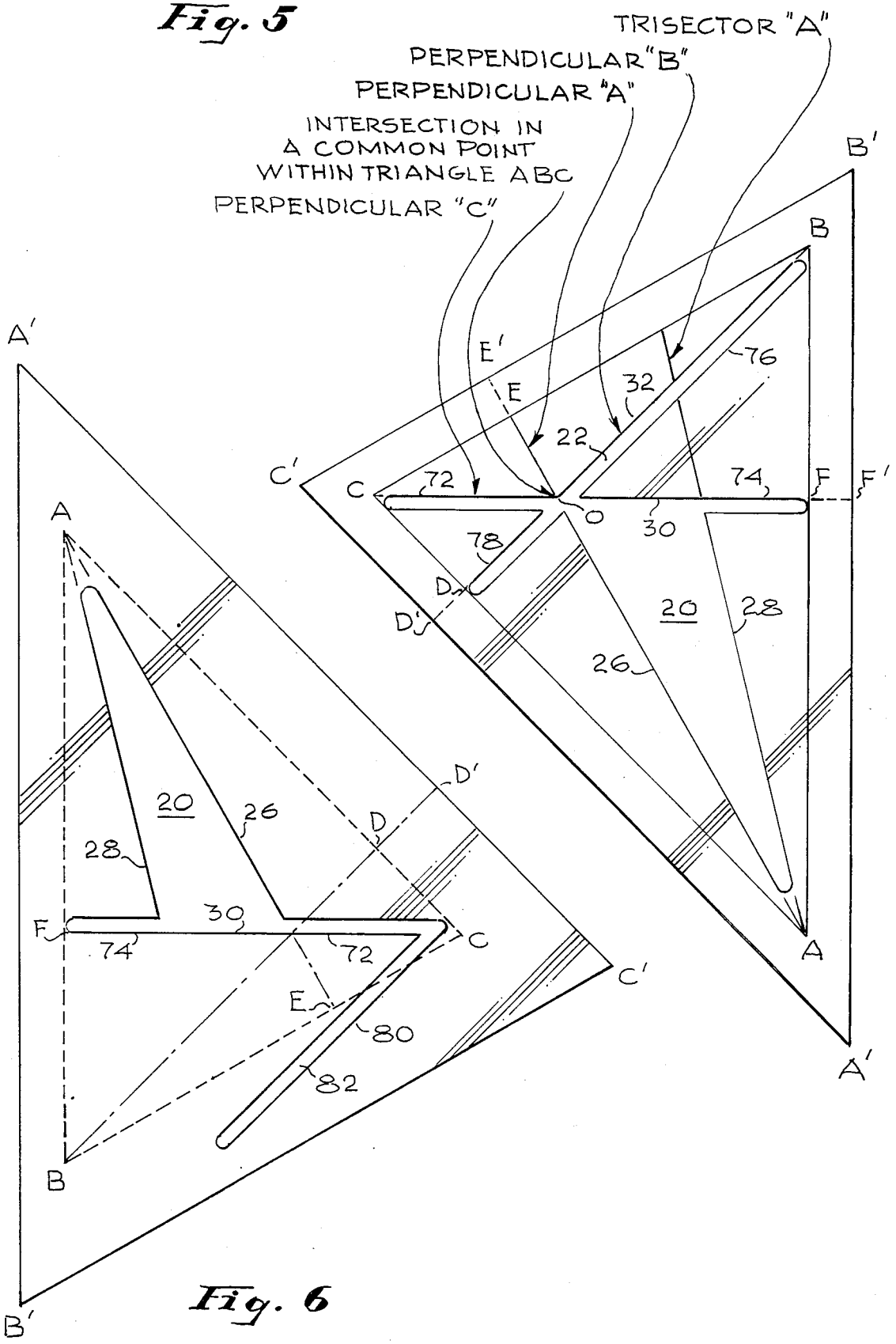
FIG. 5 is a diagram illustrating the construction of one particular arrangement in accordance with the present invention.
FIG. 6 shows a triangle, constructed similarly to that of FIG. 5, with translation of one of the internal edges.

Referring now to FIG. 5, the triangle ABC illustrates the thesis of the invention which is based on the perpendiculars from the apex of each angle to the side opposite and the working edges laid along these perpendiculars, with the addition of the trisector of the angle A, also with a working edge laid along this trisector. As in the basic configuration of FIG. 1, the edges 26, 30 and 32 lie along the respective altitudes of the triangle ABC and the edge 28 lies along an additional trisector of the angle A. For purposes of construction, additional slots 72, 74 have been provided as extensions of the edge 30, and additional slots 76, 78 have been provided as extensions of the slot 22 along edge 32. In the example of FIG. 5, these additional slots run the full length of their respective altitudes BD and CF. This would be intolerable if triangle ABC were the external triangle. Instead, the external triangle A'B'C' is formed by developing this as a similar triangle circumscribed about what is referred to as the phantom triangle ABC. The edges of the external triangle A'B'C' are translated in parallel from the edges of the phantom triangle ABC and the additional outline regions thus provide the desired structural integrity for the implement. These external edges may be, but are not required to be, respectively equidistant from corresponding edges of the phantom triangle ABC. Since the corresponding edges of the two triangles are parallel, the respective perpendiculars of the phantom triangle ABC are also perpendiculars for the triangle A'B'C', although they will no longer be altitudes of the triangle A'B'C'. However, these perpendiculars may still intersect at the common point O.

Other translations of interior working angles can be accomplished by moving working edges laterally but remaining parallel to the basic perpendiculars through points A, B and C, and/or the trisector. One such example is illustrated in FIG. 6, which is similar to the arrangement shown in FIG. 5 with the exception that the edge which is denominated 32 in FIG. 5 has been translated in parallel to become the edge 80 defining a corresponding slot 82. This edge 80 is still parallel to the perpendicular BDD'. Since line BD' is perpendicular to the external edge A'C', and the edge 80 is parallel to the line BD', the edge 80 is also perpendicular to the line A'C'. The external edge B'C' is displaced farther from the edge BC of the phantom triangle than is the case in the implement of FIG. 5, in order to develop the requisite edge area for accommodating the slot 82. Although the number and variety of the angles available in the implement of FIG. 6 may be reduced from those shown in some of the other configurations, the principal utility functions are retained. The implement of FIG. 6 still provides appropriate edges for the drafting of lines in 15° increments within a range from 15° to 135°.

Although there have been described above specific arrangements of a designer's triangle in accordance with the invention for the purpose of illustrating the manner in which the invention may be used to advantage, it will be appreciated that the invention is not limited thereto. Accordingly, any any all modifications, variations and equivalent arrangements which may occur to those skilled in the art should be considered to be within the scope of the invention as defined in the appended claims.

What is claimed is:

1. A designer's triangle comprising:

an external triangle of generally planar sheet material;

a plurality of internal edges defining an internal cutout in the form of a first internal triangle and a slot connected therewith;

wherein at least two edges of the first internal triangle and one edge of the slot extend along respective perpendiculars of the three sides of the external triangle.

2. The device of claim 1 wherein the perpendiculars intersect at a common point.

3. The device of claim 2 wherein the perpendiculars are coincident with altitudes of the external triangle.

4. The device of claim 2 wherein the perpendiculars are coincident with altitudes of a triangular figure which is circumscribed by the external triangle.

5. The device of claim 1 wherein the third edge of the first internal triangle is aligned with a trisector of one of the angles of the external triangle.

6. The device of claim 5 wherein two edges of the first internal triangle are aligned with respective trisectors of one of the angles of the external triangle.

7. The device of claim 6 wherein said two edges extend along respective trisectors of one of the angles of the external triangle.

8. The device of claim 1 wherein two edges of the first internal triangle and one edge of the slot lie along lines defining a second internal triangle.

9. The device of claim 8 wherein the angles of the first internal triangle are 15°, 60° and 105°, respectively.

10. The device of claim 8 wherein the angles of the second internal triangle are 15°, 60° and 105°, respectively.

11. The device of claim 10 wherein the first and second internal triangles are mirror images of each other.

12. The device of claim 8 wherein two edges of the first internal triangle lie along lines which are common to two edges of the second internal triangle.

13. The device of claim 1 wherein the angles of the external triangle are 45°, 60° and 75°, respectively.

14. The device of claim 1 wherein the internal cutout comprises additional slots provided as extensions of one edge of the first internal triangle to give additional working length for said edge.

15. The device of claim 1 wherein said slot is extended along the edge of the internal cutout defining said slot to give additional working length for the slot.

16. The device of claim 1 where at least one edge of the first internal triangle is translated parallel to an altitude of the external triangle.

17. The device of claim 5 wherein at least one edge of the first internal triangle is translated parallel to a trisector of one of the angles of the external triangle.

18. The device of claim 6 wherein the two edges of the internal triangle aligned with trisectors of one of the angles of the external triangle are translated parallel to said trisectors.

19. The device of claim 1 wherein the slot is translated parallel to a corresponding altitude of the external triangle.

20. The device of claim 1 wherein the generally planar sheet material comprises a clear transparent plastic material.

21. A designer's triangle comprising:

a generally planar sheet having three external edges forming a triangle with angles of 45°, 60°, and 75°, respectively;

said planar sheet having an internal cutout with internal edges extending along lines defining first and second internal triangles;

said first and second internal triangles having two internal edge defined sides in common, one of said two common sides being on an altitude of the external triangle which forms one trisector of the 45° angle, the other of said two common sides lying on the other trisector of the 45° angle;

the third sides of the first and second internal triangles lying respectively along the remaining altitudes of the external triangle.

22. The device of claim 21 wherein said third side of said second internal triangle extends along a slot which is contiguous with the first internal triangle.

23. A drafting implement comprising:

a sheet of generally planar plastic material shaped with three external edges defining a triangle and having a plurality of internal edges defining a cutout aligned along the three altitudes of the external triangle;

said external triangle including at least one 30°–60° triangle and one 45°–45° triangle sharing a common edge, with at least one edge of each of the included triangles aligned along a corresponding edge of the cutout.

24. The device of claim 23 wherein the common edge of the included triangles is aligned along one edge of the cutout.

25. The device of claim 24 wherein an additional edge of each of the included triangles is aligned along a corresponding additional edge of the cutout.

26. The device of claim 23 wherein the common edge of the included triangles is coincident with one of the external edges of the device, and wherein an additional edge of each included triangle is aligned along a respectively corresponding edge of the cutout.

27. A drafting implement comprising:

a sheet of generally planar plastic material shaped with three external edges intersecting by pairs to define a triangle ABC having angle ABC equal to 45°, angle BCA equal to 60° and angle CAB equal to 75°; said sheet further including a plurality of internal edges defining a cutout, three of said internal edges extending along respective altitude lines AE, BF and CD, the edge along the altitude AE constituting a portion of a side common to two included interior triangles ABE and ACE, said triangle ABE being a 45°–45° right triangle and said triangle ACE being a 30°–60° right triangle;

wherein a second of said three internal edges constitutes a portion of one side of a second 45°–45° right triangle BCD included in said sheet and the third of said three internal edges constitutes a portion of one side of a second 30°–60° right triangle BCF included in said sheet.

28. The drafting implement of claim 27 wherein said internal cutout further includes an edge extending along a trisector of the angle ABC, said trisector being the bisector of the angle CBF.

29. The drafting implement of claim 28 wherein said internal edges extend respectively along sides of a pair of internal triangles sharing a common included angle, each internal triangle having angles of 15°, 60°, and 105°.

* * * * *